United States Patent [19]

Houplain

[11] Patent Number: 4,763,231

[45] Date of Patent: Aug. 9, 1988

[54] FITTING WITH REMOVABLE SUPPORT FOR LIGHTING FIXTURES FIXED IN CEILING

[76] Inventor: Georges Houplain, Route d'Ahetze 64500, Saint Jean De Luz, France

[21] Appl. No.: 64,869

[22] Filed: Jun. 19, 1987

[30] Foreign Application Priority Data

Feb. 9, 1987 [FR] France ..... 87 01894

[51] Int. Cl.[4] ..... F21S 1/02

[52] U.S. Cl. ..... 362/148; 362/277; 362/293; 362/365; 362/368

[58] Field of Search ..... 362/364, 365, 368, 145, 362/147, 148, 150, 277, 293, 306, 321; 248/27.1, 297.3, 311.3, 407, 423, DIG. 6

[56] References Cited

U.S. PATENT DOCUMENTS

| | | | |
|---|---|---|---|
| 3,300,634 | 1/1967 | Liberman | 362/365 |
| 3,660,651 | 5/1972 | Miles, Jr. | 362/364 |
| 3,783,264 | 1/1974 | Hamilton et al. | 362/283 |
| 4,424,554 | 1/1984 | Woloski et al. | 362/365 |

FOREIGN PATENT DOCUMENTS

| | | | |
|---|---|---|---|
| 1268272 | 6/1961 | France | 362/365 |
| 1288739 | 2/1962 | France | 362/365 |

*Primary Examiner*—Samuel Scott

*Assistant Examiner*—Noah Kamen

*Attorney, Agent, or Firm*—Erwin S. Teltscher

[57] ABSTRACT

A fitting for a lighting fixture mountable in an aperture of a ceiling board, and wherein the ceiling board defines a first plane, includes a support device supporting the lighting fixture, and defining along a contour thereof a second plane substantially parallel with the first plane, a fixture-shift aiding device for shifting the lighting fixture between first and second stable positions along the support, so that the the plane of the lighting fixture may be positioned at first and second respective distances from the first plane of the ceiling, and a socket cover arranged to abut an upper portion of the lighting fixture. The support includes a tube member having on the interior thereof an inwardly projecting shoulder, a cylindrical cover slidable over the tube member, and a resilient device connecting the socket cover to the tube member. A lower portion of the lighting fixture is arranged to abut the inwardly projecting shoulder, and wherein the fixture shift-aiding device includes an O-ring which can be fittable between the tube member and the cylindrical cover, and first and second outer peripheral grooves formed in the tube member, and spaced from one another. The O-ring is capable to snap into respective of the grooves when the tube member is shifted between the first and second positions.

6 Claims, 3 Drawing Sheets

FIG.6
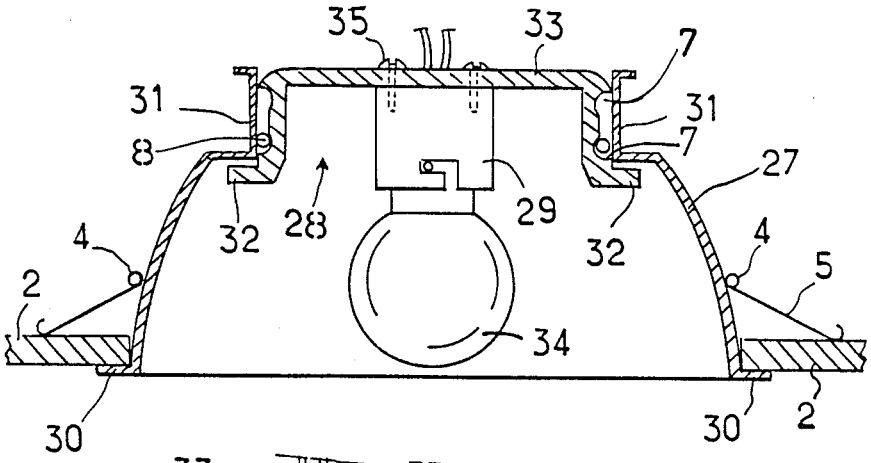
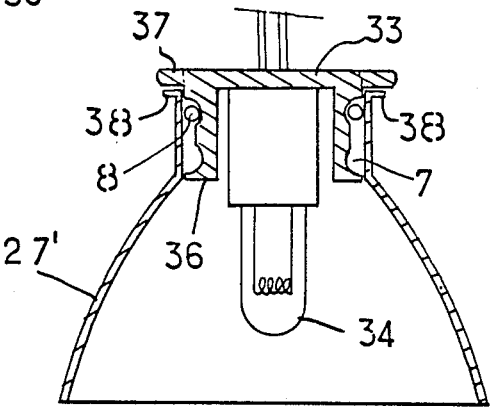
FIG.7
FIG.8
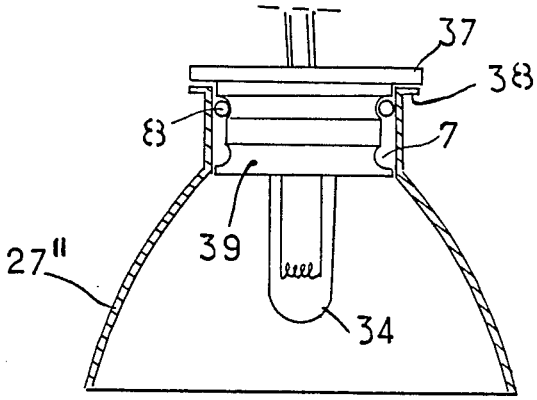

FITTING WITH REMOVABLE SUPPORT FOR LIGHTING FIXTURES FIXED IN CEILING

BACKGROUND OF THE INVENTION

There are presently known, i.e. prior art low-voltage lighting fixtures, which are fixed within or secured to ceiling boards by means of a support which is applied on the ceiling boards by leaf springs.

A major drawback of these lighting fixtures of the prior art is that it is impossible to remove the lighting fixture from its support, for example, in order to change or replace the lighting fixture.

This occurs because the lighting fixture is mounted within a circular opening of a horizontal part of the support, which makes it impossible to reach the fixture. Thus, a technician must take down the ceiling boards nearest to each lighting fixture, in order, for example, to check or replace a fixture. This constraint causes a considerable loss of time, and will often, after some time, cause the ceiling boards to deteriorate.

SUMMARY OF THE INVENTION

A novel fitting, which is the object of the invention, makes it possible to overcome these drawbacks. The lighting fixture may easily be removed from the support, placed within the support, or connected to a socket, without the need to remove part of the suspended ceiling.

The fitting, which is described in the present application, includes a receptacle which is placed in the ceiling, and can be secured to the boards of the ceiling by any suitable devices, such as springs, clips, screws, and the like.

A cylindrical steel, aluminium, or plastic support for a lighting fixture is slid into a lower opening of the receptacle. Two grooves are formed around the outer side of the removable support, which latter is in close contact with the stationary receptacle; the grooves serve for housing a rubber O ring, which attaches the support to the receptacle.

The lighting fixture support may be removed from its housing (i.e. the receptacle set in the ceiling), with the aid of an accessible peripheral rim located at the support's base, which rim is used for pulling out the support from the receptacle. How this is achieved in the various embodiments of the lighting fixture will be explained later in the specification, or can alternately be ascertained from the drawings. The rim is visible below the ceiling boards. The lighting fixture may consist of an integral reflector and bulb, or of a bulb with a separate reflector.

When the lighting fixture's support is removed, the support pulls the lighting fixture, as well as the socket of the lighting fixture along with it. The socket, lighting fixture, and removable support are held together by any appropriate means, such as rubber bands, springs, clips, etc.

This type of removable support, which makes it easier to replace the bulb, may be used in other appliances too, such as suspended lamps, lamps with brackets, and the like.

Several removable supports of this type may be placed in either a single (stationary) support or in a single appliance.

BRIEF DESCRIPTION OF THE DRAWING

The drawings annexed illustrate other technical characteristics of the invention, and make it possible to understand the invention better. In the drawings:

FIG. 6 is a fragmentary sectional view in elevation of a reflector with a support, with a socket, and and with a bulb;

FIG. 7 is a fragmentary sectional view in elevation on another scale of another version of the support, as placed in the reflector; and FIG. 8 is a fragmentary sectional view in elevation of still another version of the design of the support.

DESCRIPTION OF THE PREFERRED EMBODIMENTS

Figure 1:
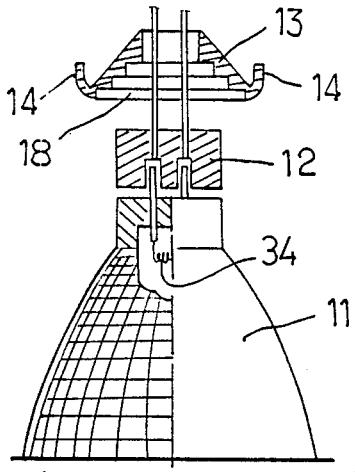
FIG. 1 is a fragmentary sectioned view in elevation of a lighting fixture with a socket and a socket cover.
Figure 2:
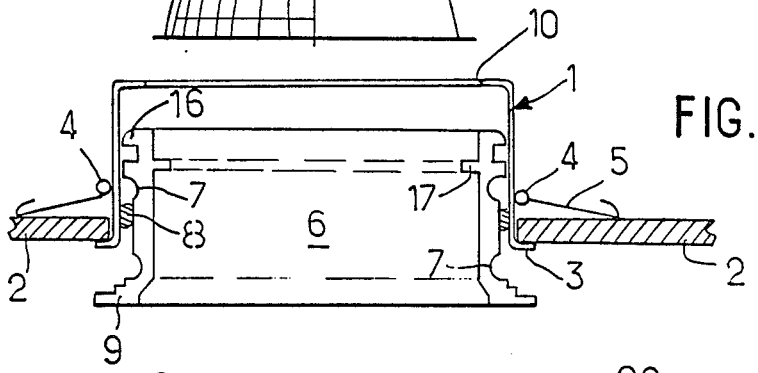
FIG. 2 is a fragmentary sectioned view in elevation of a receptacle with a removable support for a lighting fixture.
Figure 5:
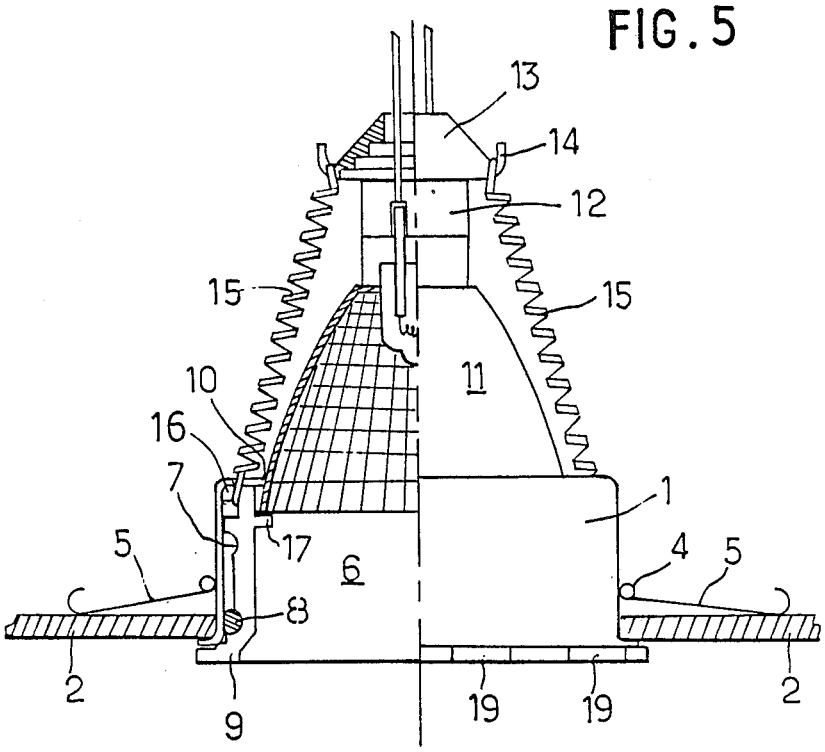
FIG. 5 is a fragmentary view in elevation, part sectioned, of the fitting as assembled and set in the ceiling.

As shown in FIGS. 1, 2, and 5, the fitting includes a receptacle 1 set into the ceiling in an aperture provided in a board 2 of the ceiling. The receptacle 1 is cylindrical, and is placed upside down in such a way that its rim 3 abuts the board 2 around the circular perimeter of the aperture. Receptacle 1 is fitted on its outer side with springs 4, which in turn are provided with pins 5. Pins 5 are applied on the upper surface of the boards 2 of the ceiling. A sliding cylindrical support 6 for a lighting fixture can be arranged to slide into the receptacle 1. The outer diameter of the support 6 of the lighting fixture is slightly smaller than than the inner diameter of the receptacle 1, so that the support 6 may slide easily on the inside of the receptacle 1. The receptacle 1 is formed with a circular opening 10 on its upper part, and the diameter of the circular opening 10 is roughly equal to the inner diameter of support 6 of the lighting fixture. The support 6 is formed on the outside with two peripheral grooves 7, separated by a narrow flat portion, and an O ring 8 is placed into one of the grooves 7. The bottom of the support 6 is formed with a peripheral rim 9, which is used for pulling out the support 6 from the receptacle 1, while the O ring 8 is dislodged from the lower groove 7 and is placed into the upper groove 7. The rim 9 is formed with slots 19 at regular intervals on its perimeter, as best seen in FIG. 5, and the slots 19 are directed towards the outside of support 6. As the support 6 moves downwards, it pulls the lighting fixture 11, as well as its socket 12, and the cover 13 along with it; the socket cover 13 is fitted with oppositely placed hooks 14. This makes it possible to hold the lighting fixture 11 together with support 6 by means of two springs 1, seen in FIG. 5. The lower ends of the springs 15 are respectively secured to two hooks 16, which form respective solid parts of the upper surface of the support 6. The peripheral base of the lighting fixture 11 rests on, or fits into a slot 17, acting as a stop. The slot 17 is located on the upper part of the interior of support 6. The socket cover 13 is formed with an interior recess 18 which becomes stepwise narrower in an upward direction, as seen from the base of the cover, so as to allow for different types of sockets. This is best seen in FIGS. 1 and 5.

Support 6, the lighting fixture 11, and the socket cover 13, make up a removable set of elements.

Figure 3:
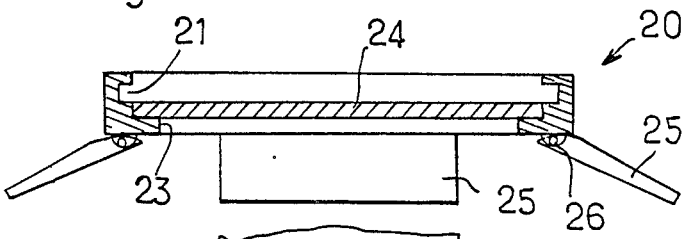
FIG. 3 is a fragmentary cross-section in elevation of an element having a light filter and reflecting shutters.
Figure 4:
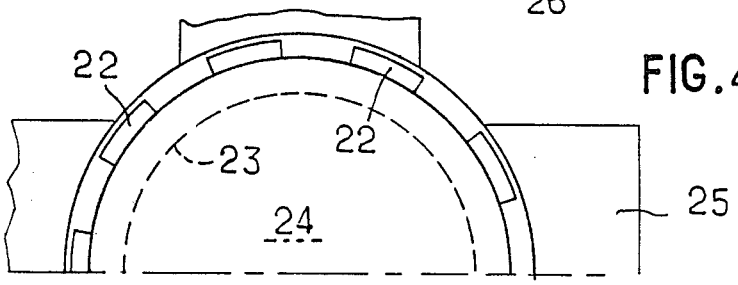
FIG. 4 is a fragmentary top plan view of the element having the reflecting shutters.

FIGS. 3 and 4 represent a connector part 20 which is adapted to fit onto the rim 9 at the base of support 6 of the lighting fixture. Part 20 is in the shape of a ring whose cross-section has a rectangular contour, and which has a groove 21 on its interior, and is formed with slots 22 at the top. Slots 22 are directed towards the center, so that by placing part 20 beneath the support 6, the rim 9 fits into the groove 21 by means of the slots 19. A half-turn of the part 20 then locks it onto the rim 9. The lower surface of the part 20 consists of an inner rim on which is placed a filter 24.

The rim 23 of the part 20, also contains shutters 25 which reflect light waves. Shutters 25 are mounted pivotally upon pins 26. The shutters 26 may be either flat or curved in shape.

FIGS. 6, 7, and 8 represent simplified versions of the fitting in accordance with the invention, in so far as the receptacle 1, the socket cover 13, and the springs 15, are dispensed with.

As shown in FIG. 6, another version of the fitting includes a reflector 27 which is roughly parabolic in shape and open at both ends. The narrower end of the reflector 27 encloses a removable support 28 supporting a socket 29, whereas the wider end of the reflector 27 engages with the ceiling board 2 through an aperture provided in the ceiling board 2. This engagement is performed by means of the ceiling board's lower rim 30 provided with springs 4 fitted by pins 5. The pins 5 press upon the upper surface of the ceiling board 2.

The narrow top opening of the reflector 27 is made up of a cylindrical part 31 high or wide enough to allow for the movement of the removable support 28. The removable support 28 is actuated or moved manually through the wide opening of the reflector by means of a prehensile rim 32.

The removable support 28 is cylindrical in shape and its upper part is closed by a plate 33 bearign a socket 29 and a bulb 34. The removable support 28 is formed on its outer periphery with two peripheral grooves 7 with a narrow flat portion between them. Into either of these grooves 7, in turn, there is placed an O ring 8, which is partly compressed by the inside of the cylindrical part 31 of the reflector 27. The O ring 8 rests in the groove nearest to the rim 32, when the removable support 28 is fully pushed back upwardly into the reflector 27, and the retraction of the support 28 (downwardly) by means of the rim 32 causes the O ring 8 to be temporarily compressed. The O ring 8 then becomes dislodged from the lower groove 7 and moves into the other or upper groove 7.

The socket 29 is mounted by means of two screws 35 onto the plate 33, which is solid with the removable support 28. The support 28 is held in place by being pressed directly against the reflector 27 by means of the O ring 8.

FIG. 7 shows another version of a design for assembling the removable support, which is different from that shown in FIG. 6. Here the removable support 36 is pushed into position and maneuvered from the outside, namely from the back or top of the narrow opening of a reflector 27'. This is done manually by means of a peripheral prehensile rim 37, which abuts the back or top end 8 of the reflector 27'.

FIG. 8 shows yet another version of the design of the removable support. This version differs from that shown in FIG. 7 in so far as the removable support and the socket make up a one-piece set 39, which is formed with a prehensile rim 37. The rim 37 is shown at the back or top of a reflector 27" for handling from the rear or top, but it could also be placed in front, (in an embodiment which is not shown) in order to make it possible to pull the entire set out frontwardly, or downwardly.

The removable fitting which is the object of the invention can be used for lamps set in the ceiling, set in walls, or set in partitions. It could also be used for portable lamps, and the like. Applications are also possible for the headlights of vehicles.

What is claimed:

1. A fitting for a lighting fixture mountable in an aperture of a ceiling board, and wherein the ceiling board defines a first plane, comprising in combination support means supporting said lighting fixture, and defining along a contour thereof a second plane substantially parallel with said first plane, fixture-shift aiding means for shifting said lighting fixture between first and second stable positions along said support means, so that said second plane of said lighting fixture may be positioned at first and second respective distances from said first plane of said ceiling board, and a socket cover arranged to abut an upper portion of said lighting fixture, and wherein said support means includes a tube member having on the interior thereof an inwardly projecting shoulder, a cylindrical cover slidable over said tube member, and resilient means connecting said socket cover to said tube member, a lower portion of said lighting fixture being arranged to abut said inwardly projecting shoulder, and wherein said fixture shift-aiding means includes an O-ring fittable between said tube member and said cylindrical cover, and first and second outer peripheral grooves formed in said tube member, and being spaced from one another, said O-ring being capable to snap into respective of said grooves when said tube member is shifted between said first and second positions.

2. The fitting according to claim 1, further comprising a connector fitted with adjustable light reflector means, and being releasably securable to a lower side of said support means, and filter means for filtering light radiated by said lighting fixture.

3. The fitting according to claim 1, wherein said tube member includes an outwardly projecting first rim on an upper portion thereof, and said lighting fixture includes outwardly projecting rim on an upper part thereof, said rims being arranged to abut one another.

4. A fitting for a lighting fixture mountable in an aperture of a ceiling board, and wherein the ceiling board defines a first plane, comprising in combination support means supporting said lighting fixture, and defining along a contour thereof a second plane substantially parallel with said first plane, fixture-shift aiding means for shifting said lighting fixture between first and second stable positions along said support means, so that said second plane of said lighting fixture may be positioned at first and second respective distances from said first plane of said ceiling board, and a socket cover arranged to abut an upper portion of said lighting fixture, and wherein said support means includes a tube member having on the interior thereof an inwardly projecting shoulder, a cylindrical cover slidable over said tube member, and resilient means connecting said socket cover to said tube member, a lower portion of said lighting fixture being arranged to abut said inwardly projecting shoulder, and wherein said fixture shift-aiding means includes an O-ring fittable between said tube member and said cylindrical cover, and first and second outer peripheral grooves formed in said tube member, and being spaced from one another, said O-ring being capable to snap into respective of said grooves when said tube member is shifted between said first and second positions and a connector fitted with adjustable shutter means, and releasable securing means rotatably attachable to a lower side of said tube member, and filter means for filtering light radiated by said lighting fixture.

5. The fitting according to claim 1, further comprising additional resilient means attached to to said cover, bearing on an upper side of said ceiling board, and being arranged to abut said support means on an external side thereof.

6. The fitting according to claim 5, further comprising a socket cover arranged to abut an upper portion of said lighting fixture, said socket cover being provided with with a first set of upwardly projecting hooks, said support means being provided with a second set of hooks, and wherein said resilient means is constituted by tension springs connectable to said first and second sets of hooks.

* * * * *